US006941710B2

(12) United States Patent
Eden

(10) Patent No.: US 6,941,710 B2
(45) Date of Patent: Sep. 13, 2005

(54) COLUMNAR JACK CONCEALING DEVICE

(76) Inventor: Scott A. Eden, N. 18249 Lily Lake La., Dunbar, WI (US) 54119

( * ) Notice: Subject to any disclaimer, the term of this patent is extended or adjusted under 35 U.S.C. 154(b) by 322 days.

(21) Appl. No.: 09/872,899

(22) Filed: Jun. 2, 2001

(65) Prior Publication Data

US 2002/0178686 A1 Dec. 5, 2002

(51) Int. Cl.[7] ..... E02D 5/72; E02D 5/74

(52) U.S. Cl. ..... 52/170; 52/126.4; 52/169.13; 52/219; 52/736.3; 52/737.4; 52/297; 256/1; 405/216; 248/354.1

(58) Field of Search ..... 52/169.13, 219, 52/126.4, 126.3, 736.3, 514, 170, 737.5, 737.4, 737.1, 732.1, 736.2, 738.1, 730.5, 233, 288.1, 297, 298, 651.1; 256/1, 65.14; 428/40.1; 285/424, 417; 405/230, 211, 216; 24/274 R, 306, 442, 326; 248/354.1

(56) References Cited

U.S. PATENT DOCUMENTS

| | | | | | |
|---|---|---|---|---|---|
| 381,671 | A | * | 4/1888 | Brown | 52/721.5 |
| 868,953 | A | * | 10/1907 | White | 52/302.5 |
| 934,176 | A | * | 9/1909 | Hubbard | 405/216 |
| 1,048,855 | A | * | 12/1912 | Murdock | 285/331 |
| 1,095,197 | A | * | 5/1914 | Entenmann | 52/297 |
| 1,113,558 | A | * | 10/1914 | Illingworth | 52/232 |
| 1,668,486 | A | * | 5/1928 | Betts | 52/737.5 |
| 2,928,411 | A | * | 3/1960 | Johnson | 137/236.1 |
| 2,943,876 | A | * | 7/1960 | Morris | 403/313 |
| 3,027,610 | A | * | 4/1962 | Liddell | 405/216 |
| 3,049,195 | A | * | 8/1962 | Leat et al. | 52/126.4 |
| 3,081,114 | A | * | 3/1963 | Esty | 52/737.3 |
| 3,139,731 | A | * | 7/1964 | Liddell | 405/216 |
| 3,196,495 | A | | 7/1965 | Owen | |
| 3,233,922 | A | * | 2/1966 | Evans | 285/236 |
| 3,276,182 | A | | 10/1966 | Handley | |
| 3,321,924 | A | * | 5/1967 | Liddell | 405/216 |
| 3,390,951 | A | * | 7/1968 | Finger et al. | 52/516 |
| 3,397,260 | A | * | 8/1968 | Lamberton | 264/86 |
| 3,560,287 | A | * | 2/1971 | Helling | 52/737.4 |
| 3,720,068 | A | * | 3/1973 | Rosa | 52/737.4 |
| 3,890,795 | A | * | 6/1975 | Maurer | 405/216 |

(Continued)

FOREIGN PATENT DOCUMENTS

| | | | | |
|---|---|---|---|---|
| JP | 244052 | * | 9/1989 | 52/737.4 |
| JP | 44300 | * | 2/1993 | 52/737.4 |
| JP | 42111 | * | 2/1994 | 52/730.5 |

*Primary Examiner*—Phi Dieu Tran A
(74) *Attorney, Agent, or Firm*—Meroni & Meroni, P.C.; Christopher J. Scott; Charles F. Meroni, Jr.

(57) ABSTRACT

The present invention provides a device for concealing and covering a columnar jack for columnar supports and a method of concealing a columnar jack using a columnar jack concealing kit. The device comprises a strap member, a skirt sized and shaped for covering the columnar jack, and a band member for attaching the skirt to the strap member. The strap member is sized and shaped for folding over and enclosing the band member and a portion of the skirt. The adjustable clamp member can attach the adjustable shield member with the adjustable strap member to the columnar support. The adjustable shield member can conceal and shield the columnar jack and the adjustable strap member can enclose the adjustable clamp member.

16 Claims, 5 Drawing Sheets

U.S. PATENT DOCUMENTS 3,939,665 A * 2/1976 Gosse et al. ..... 405/216
3,941,159 A * 3/1976 Toll ..... 138/147
3,964,772 A * 6/1976 Cox, Jr. ..... 285/39
3,999,399 A * 12/1976 Maurer ..... 405/215
4,019,301 A 4/1977 Fox
4,068,483 A * 1/1978 Papworth ..... 405/216
4,183,557 A * 1/1980 Hinden ..... 285/53
4,255,071 A * 3/1981 Koppers et al. ..... 405/290
4,306,821 A * 12/1981 Moore ..... 405/216
4,585,091 A * 4/1986 Budd ..... 181/243
4,606,167 A * 8/1986 Thorne ..... 52/727
4,653,420 A * 3/1987 Johnson ..... 114/219
4,764,054 A * 8/1988 Sutton ..... 405/216
4,921,555 A * 5/1990 Skiff ..... 156/98
5,043,033 A * 8/1991 Fyfe ..... 156/71
5,054,011 A * 10/1991 Alves ..... 369/12
5,138,806 A * 8/1992 Marx et al. ..... 52/170
5,335,471 A 8/1994 Kupiec
5,348,330 A 9/1994 Few et al.
5,400,994 A * 3/1995 Shawwaf et al. ..... 248/354.3
5,505,500 A * 4/1996 Webb et al. ..... 285/223
5,516,236 A * 5/1996 Williams et al. ..... 405/216
5,562,364 A * 10/1996 Darder-Alomar ..... 405/215
5,605,414 A * 2/1997 Fuller et al. ..... 40/607.11
5,848,715 A 12/1998 Duncan
5,869,159 A * 2/1999 Padilla ..... 428/40.1
5,899,044 A 5/1999 Jarrett
6,065,268 A * 5/2000 Gump ..... 52/737.4
6,102,437 A 8/2000 McLane
6,115,988 A * 9/2000 Reisdorff ..... 52/741.14
6,148,585 A * 11/2000 Baker ..... 52/737.4
6,364,575 B1 * 4/2002 Bradley et al. ..... 405/216

* cited by examiner

COLUMNAR JACK CONCEALING DEVICE

BACKGROUND OF THE INVENTION

1. Field of the Invention

The present invention relates to columnar concealing or covering devices for columnar jacks and a method of protectively concealing columnar jacks. More specifically, the present invention is primarily intended as a shielding or concealing apparatus or device and a method of installation for columnar jacks that may be used for leveling, supporting and securing structural support members on structures such as cabins, homes, buildings, garages, signs, and the like, where the structural support members can include columns, posts, beams,joists and so forth.

2. Description of the Related Art

Structural support members, such as columns, posts, beams, joists, and so forth are an important structural aspect in construction of homes, buildings, garages, signs, and the like. Maintaining a structurally secure, level connection between the structural support member and the member(s) it supports is critical to the stability of the structure. Moreover, maintaining a level surface, such as a level roof, is critical to the stability and safety of a structure as well as to the aesthetics imparted to the beholder. Columnar jacks, including adjustable columnar jacks or screw-jacks, are often used to maintain this secure connection, to adjust and to level a surface, and to compensate for the disparity in the construction process, materials, and so forth. Such disparities can be caused in timber construction, for example, due to the swelling and shrinkage characteristics of wood, to swelling and shrinkage of underlying soils, or to the availability and usage of materials that are shorter than the required material lengths.

When columnar jacks are used for columnar support securement, aesthetic, structural, and safety issues must be addressed. Protection of the columnar jack from slippage or movement, as well as overall aesthetic appearance, become important objectives. These issues can be addressed by concealing and shielding the columnar jack from outside view. In an effort to address these issues, devices have been developed to conceal and shield columnar jacks and columnar members.

For example, U.S. Pat. No. 6,065,268, which issued to Gump, discloses a plastic decorative and protective sheath designed to cover jacks used to stabilize house beams, to lift and level mobile homes and the like. The '268 jack cover comprises three half-sectioned covering parts: a capital, a column, and a base and requires adhesives and tongue and groove connections. However, in the field of wood construction, such as in construction of a log cabin, natural wood aesthetics are important and the '268 jack cover would extend the full length of the column and would cover the natural aesthetics of the wood columns used. Moreover, any variation in the height of the column would require an additional cutting operation of the '268 jack cover and subsequent material waste. Once cut, the '268 jack cover would not fully cover the column should the length increase or if a new, longer column were used. Moreover, once cut, the '268 jack cover would not completely compensate for the shrinking and swelling dimensions of the underlying column and gaps or failure points in the parts could weaken the strength and the aesthetics of the cover.

U.S. Pat. No. 3,049,195, which issued to J. H. Leat et al., discloses Demountable Partitions that utilize stanchions and small screw jack devices. The small screw jacks are covered by molding or skirting strips having ribs for insertion into the groove of a channel strip as well as splayed edges (see. FIGS. 1, 7, 10, 11, 12 and 14 of the '195 Patent). However, the '195 molding or skirting strips are disclosed in panel construction and must be manufactured for each wall-to-panel gap size and orientation. In addition, the molding or skirting strips require the cooperation of specially cut and placed channeling strip(s). This construction technique could become onerous and would affect aesthetics in columnar construction, particularly in wood construction where again, the natural material aesthetics are required.

It is therefore important and necessary that a columnar covering device for a columnar jack be developed that has universal application with varying columnar construction sizes, shapes, and lengths, requires few working parts, reduces the likelihood of material waste, accommodates immediate access for jack and material adjustments, due to such causes as shrinkage and swelling, and is easy to use and manufacture. It is thus an object of the present invention to provide a structural column assembly for providing aesthetically adjustable columnar support to a building structure. It is a further object of the present invention to provide a structural column assembly kit for aesthetically and adjustably outfitting a columnar support of a building structure.

Other objects of my invention, as well as particular features, elements, and advantages thereof, will be elucidated in, or apparent from, the following description and the accompanying drawing figures.

SUMMARY OF THE INVENTION

The present invention provides a columnar covering device for a columnar jack and a method of installing a columnar jack concealing kit for a columnar support. According to the present invention a columnar covering device for a columnar jack is provided and comprises a strap member, a skirt for circumferentially covering the columnar jack, and a band member for attaching the skirt to the strap member. The strap member is sized and shaped for folding over upon itself and for enclosing the band member and a portion of the skirt. The present invention can allow quick access to the columnar jack for adjusting purposes and can be used, for example, on a columnar jack on a cabin structure.

In another embodiment, the present invention provides an apparatus for shielding a columnar structure supporting device, such as a columnar jack. The apparatus comprises a first adjustable band member, a second adjustable band member, and an adjustable is shield member for shielding the structure supporting device. The second adjustable band member can couple the first adjustable band member with the adjustable shield member and the first adjustable band member can enclose the second adjustable band member.

In a further embodiment of the present invention, in combination, an apparatus for shielding a columnar structure supporting device is provided. The combination comprises a first adjustable band member, a second adjustable band member, an adjustable shield member for shielding the columnar structure supporting device, and a structural support. The second adjustable band member can couple the first adjustable band member with the adjustable shield member and with the structural support. The first adjustable band member can then enclose the second adjustable band member.

In another embodiment of the present invention, a columnar jack concealing kit for columnar supports is disclosed. The kit comprises a columnar jack for supporting the columnar support, an adjustable strap member, an adjustable shield member, and an adjustable clamp member. The adjustable clamp member can attach the adjustable shield member with the adjustable strap member and then attach both to the columnar support. The adjustable shield member can conceal and shield the columnar jack from view. Finally, the adjustable strap member can enclose the adjustable clamp member and shield it from view for presenting a uniform appearance blending with the columnar support supported by the columnar jack.

In still a further embodiment, in combination, a columnar jack concealing structure for a columnar support of a structure is provided. The combination comprises an adjustable, flexible strap, an adjustable, stiff skirt, a mechanically adjustable clamp, an adjustable columnar jack, and the columnar support. The adjustable columnar jack can support and secure the columnar support. The adjustable, flexible strap can surround and engage a portion of the columnar support adjacent the adjustable columnar jack. The mechanically adjustable clamp can attach the adjustable, stiff skirt to the adjustable, flexible strap and to the columnar support. Then the adjustable, stiff skirt can conceal the adjustable columnar jack as the skirt is circumferentially adjustable relative to the columnar support for concealing the columnar jack. Finally, the adjustable, flexible strap can fold over upon itself and can encase and protect the mechanically adjustable clamp.

Finally, the present invention provides a method of concealing a columnar jack using a columnar jack concealing kit with a columnar support, the method comprising the acts of: first, providing a columnar jack, then attaching the columnar jack to the columnar support and adjusting the columnar jack for securing the columnar support. Next is wrapping an adjustable, flexible strap about the secured columnar support and adjusting the adjustable, flexible strap upon itself for securing the adjustable, flexible strap to the secured columnar support. The next act is wrapping an adjustable, stiff skirt about the secured adjustable, flexible strap and the secured columnar support and adjusting and securing the adjustable, stiff skirt to the secured adjustable, flexible strap and the secured columnar support. Installation continues by covering the attached columnar jack with the secured adjustable, stiff skirt and concealing the attached columnar jack from view, followed by mounting, adjusting, and securing a mechanically adjustable clamp in assembled relation around and over the secured adjustable, flexible strap, the secured adjustable, stiff skirt, and the, secured columnar support maintaining concealment of the attached columnar jack. The final act is folding the secured adjustable, flexible strap over the secured adjustable, stiff skirt and the secured mechanically adjustable clamp for concealing the secured adjustable, stiff skirt, or at least a portion thereof, and for concealing and protecting the secured mechanically adjustable clamp.

The present invention, therefore provides a columnar covering device for a columnar jack that has universal application with varying columnar construction sizes, shapes, and lengths, requires few working parts, reduces the likelihood of material waste, accommodates immediate access for the columnar jack and material adjustments, due to such causes as shrinkage and swelling, and is easy to use and manufacture.

DESCRIPTION OF THE DRAWINGS

Other features of my invention will become more evident from a consideration of the following detailed description of my patent drawings, as follows.

DETAILED DESCRIPTION OF THE PREFERRED EMBODIMENT

Figure 1:
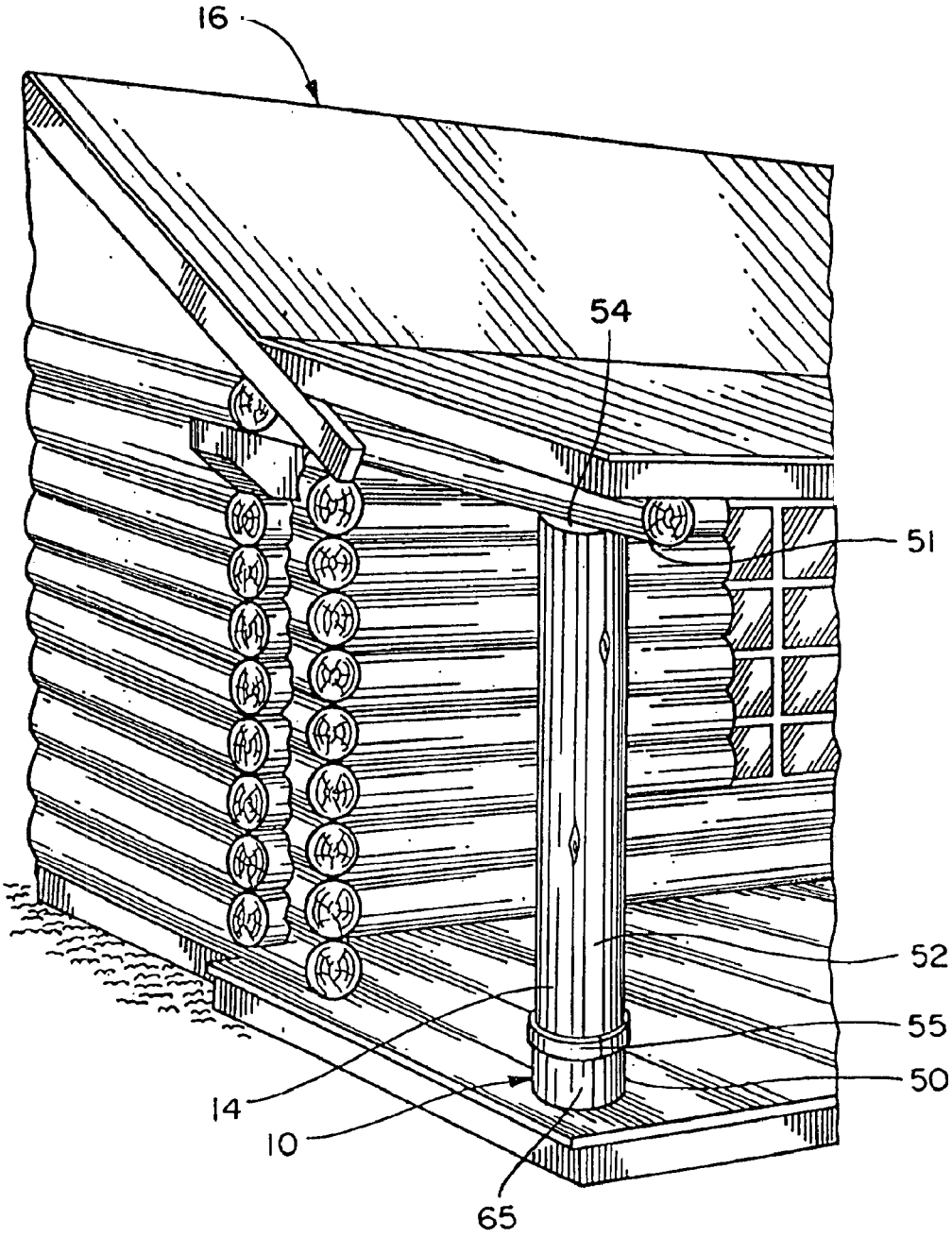
FIG. 1 is a perspective view of an embodiment of the present invention showing an application of the columnar covering device for a columnar jack as applied to a column of a log cabin-type structure.

Referring now to the drawings, the present invention concerns a columnar covering device for a columnar jack or screw-jack, illustrated by way of example in FIGS. 1–11. As discussed above in the Background of the Invention, it is very important to home and building construction and maintenance to maintain a level roof surface as well as other surfaces. In particular, in the construction and maintenance of log cabins and other wood homes, wood shrinkage must be compensated for in order to maintain a level roof surface, level deck surface, and so forth. In order to maintain the level surface, columnar jacks and other columnar support devices can be used, as described below, for adjusting the columnar supports for leveling roofs and the like and for compensating for shrinkage of the wood material. Concealment of the columnar jack and quick access and adjustment of the columnar jack to level the cabin structures is therefore of paramount importance to the functionality, safety, and aesthetics of the cabin, home or structure. The present invention can provide these key features and can satisfy these needs.

It is not intended that the present invention be limited solely to columns and wood construction nor to concealment of columnar jacks, rather it is intended that the scope of the present invention also includes other structural supports, such as posts, beams, joists and the like, other materials, such as metals, synthetics, etc., and concealment of any item used to secure the structural supports including jacks, blocks, other structural members, and so forth.

As is illustrated in FIGS. 1–11, one embodiment of the present invention discloses, a columnar covering device 10, or apparatus, for shielding a columnar structure supporting device 12, such as a columnar jack, that can be used otherwise secure a columnar support 14, such as a column, a post, a beam; a joist, and so forth. The columnar support 14 can provide structural support to a structure 16, such as the log cabin shown in FIG. 1. Other structures, including buildings, shops, signs, and the like are also included within the scope of this invention.

Figure 2:
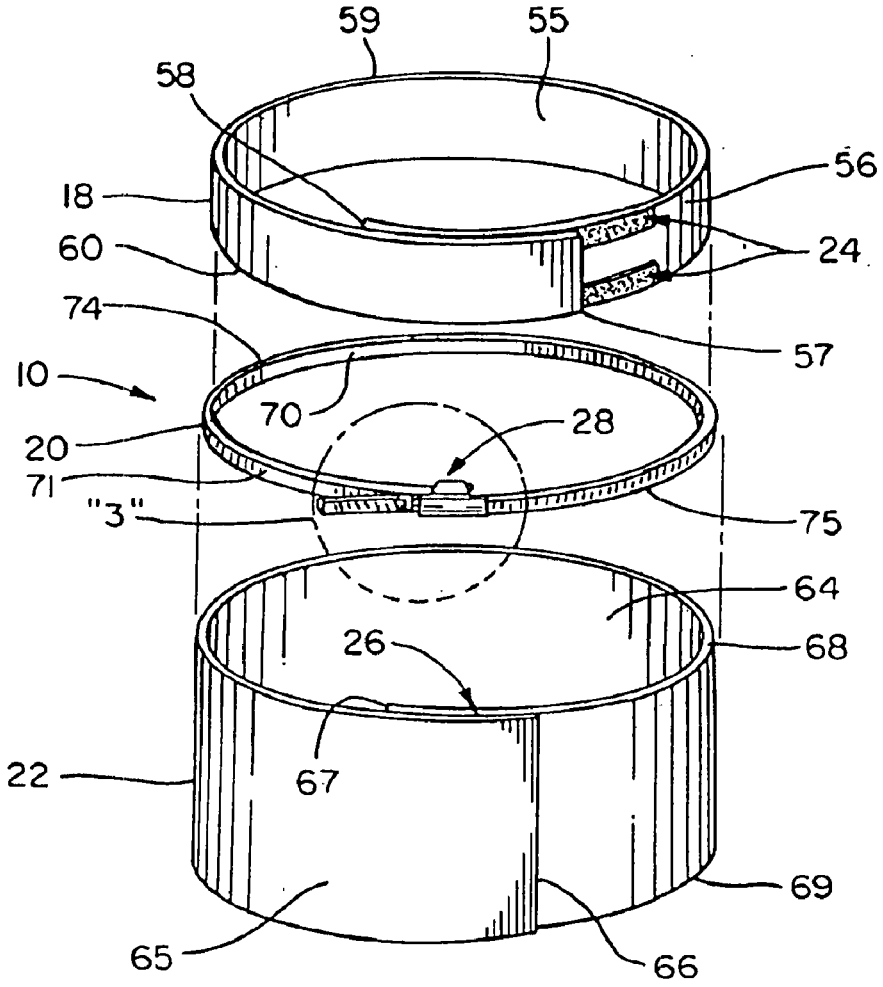
FIG. 2 is an exploded view of an embodiment of the present invention showing a strap member, a skirt member, and a band member.
Figure 3:
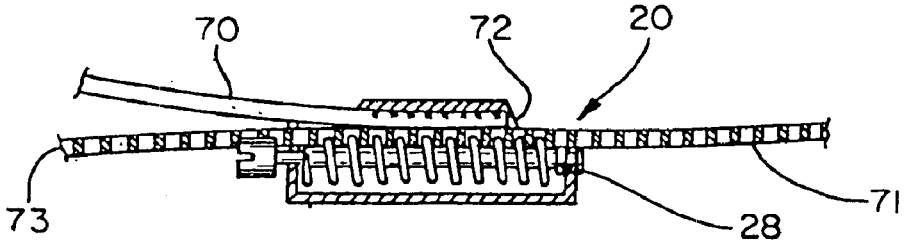
FIG. 3 is a top sectional view of the band member of the embodiment of FIG. 2 showing one type of adjustment means, a mechanical-type mechanism.
Figure 4:
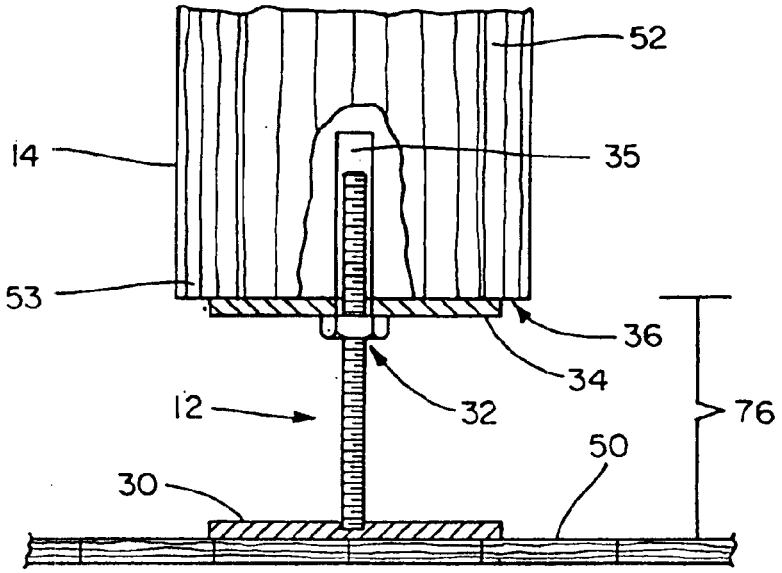
FIG. 4 is a cross-sectional view of a columnar jack of the present invention supporting a columnar member, the columnar jack having adjustable capability.

The columnar covering device 10, as shown in FIGS. 2 and 3, comprises a first adjustable band member 18, a second adjustable band member 20, and an adjustable shield member 22 for covering the columnar jack 12. In a preferred embodiment, the first adjustable band member 18 is a strap, belt-like member, or vinyl clamp cover as it is known in other embodiments. The clamp 18 has adjustment means 24 for wrapping (Arrow A—A in FIG. 9 and Arrow B—B in FIG. 11) the strap 18 around the columnar support 14, shown in FIGS. 1 and 8–11, and then over itself to secure it to the columnar support and to account for the variety of sizes, shapes, and dimensions of the columnar supports, including any circular, square, and irregularly shaped columns (i.e. knotted) and the like. In this way, the clamp 18 (and the columnar covering device 10 as a whole) can fit and adjust to any surface dimension, shape, and texture. The adjustment means 24 can include Velcro, adhesive, nails, screws, nuts, bolts, rivets, and mechanical mechanisms. In addition, the strap 18 is preferably an annular band member that has ends that can be disposed in lapped relation to adjust and secure the strap around the columnar support 14.

An important feature of the strap 18, described in detail below, is that it be constructed of a flexible material that is strong and resistant to degradation, such as from weathering elements and the like, but that can adsorb moisture and protect the underlying and adjacent wood members and other members. Materials could include synthetics (i.e. soft plastics), rubberized compounds, vinyl, cloth materials, and elastic materials. Excellent results are attainable where a soft easily foldable cloth material is used of any suitable type. In addition, the material could be manufactured to look like (or have a similar visual appearance as) the material of the columnar support 14 that it will attach to for blending into the structure. In this last regard, it is contemplated that the material used in the construction of strap 18, in order to more properly blend into the structure, be in aesthetic agreement with the columnar support or structure. As the strap 18 performs a concealing function by preferably folding radially outwards and over itself (Arrows A—A in FIG. 9 and Arrows B—B in FIG. 11) for reasons heretofore discussed, the material used must allow the strap 18, to "reverse bend", or bend over upon itself. In this way, the strap can shield the second adjustable band member 20 underneath and protect people from injuring themselves on it. The strap 18 can also provide a moisture absorption barrier, if constructed from such a material, that can prevent moisture from traveling down the columnar support 14 and contacting the entire columnar support and the underlying floor surfaces.

In a preferred embodiment, the adjustable shield member 22 is a skirt, shielding member, columnar jack cover, or adjustable sleeve, as it is known in other embodiments. The skirt 22 can be wrapped around the strap 18 and the columnar support 14 and then overlap itself, as shown in FIGS. 1 and 8–11, to secure it to the strap and columnar support and to also account for the variety of sizes, shapes, and dimensions of the columnar supports and columnar jacks 12. The skirt 22 can also be sized lengthwise to accommodate different gap and columnar jack heights to account for axial shifting (i.e. swelling, shrinking, etc.) as the columnar jack 12 secures the columnar support 14 and while maintaining concealment and protection of the columnar jack.

The skirt 22 is preferably constructed of a stiff material that will hold its shape in any orientation (i.e. right-side up, upside-down, sideways, or at any angle), will shield and conceal the columnar jack 12 from view and from weathering elements and the like, is strong, will be resistant to degradation due to the weathering elements and other factors, but which still allows quick access to the, concealed columnar jack with little effort followed by easy closing of the skirt. In addition, the skirt 22 must also be flexible so as to allow easy entrance into the columnar jack for leveling adjustments and the like. Materials can also, include synthetics, rubberized compounds, paper products, stiff cloth materials, elastic materials, and so forth. Like the strap 18, the skirt 22 could be manufactured to look like (or have a similar visual appearance as) the material of the columnar support 14 that it will attach to so as to blend into the structure and provide a uniform appearance. In this last regard, it is contemplated that the material used in the construction of skirt 22, in order to more properly blend into the structure, be in aesthetic agreement within the columnar support or building structure. Adjustment and securement of the skirt 22 can include skirt adjustment means 26, such as overlap upon itself, Velcro or adhesive attachment, or mechanical mechanism.

The second adjustable band member 20 is a clamp, a screw band clamp, or other similar clasping device as it is known in other embodiments. The clamp 20 can be wrapped around the skirt 22, the strap 18, and the columnar support 14, and then overlap itself, as shown in FIGS. 1–3 and 8–11. The clamp 20 can thereby function to secure the skirt to the strap and to the columnar support while accounting for the variety of sizes, shapes, and dimension of the columnar support. The clamp, as shown in FIGS. 2 and 3, can be constructed of a metal, synthetic, rubberized compound, rope material, and any other material within the scope of this invention. A metal clamp having a clamp adjustment means 28, as illustrated in FIGS. 2 and 3, is preferred.

Once clamped and adjusted, the strap 18 can be folded radially outwards and over itself (Arrows A—A in FIG. 9 and Arrows B—B in FIG. 11), the clamp 20, the skirt 22, and at least a portion of the columnar support 14, as shown in FIGS. 8–11. In this manner, the clamp 20 can be hidden from view and protected and the columnar covering device 10 can blend into the columnar support 14, or at least provide an aesthetically pleasing addition to the columnar support while protecting and concealing the columnar jack 12, as illustrated in FIG. 1.

Figure 5:
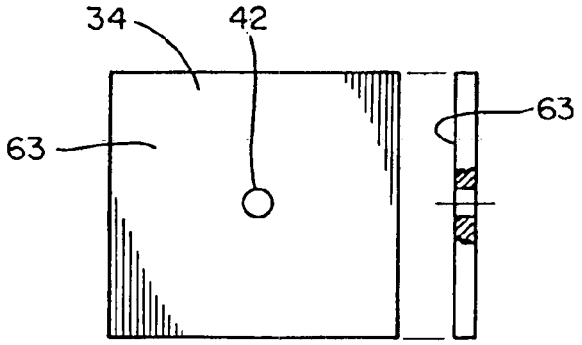
FIG. 5 is a plan and cross-sectional view of a support plate of the columnar jack of is FIG. 4.
Figure 6:
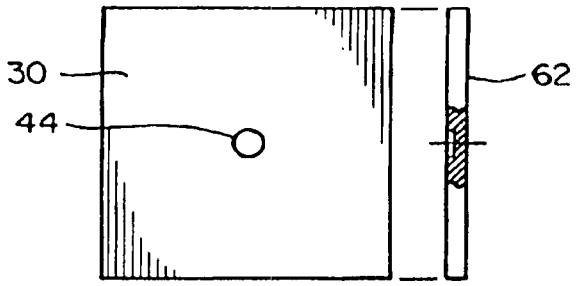
FIG. 6 is a plan and cross-sectional view of a base plate of the columnar jack of FIG. 4.
Figure 7:
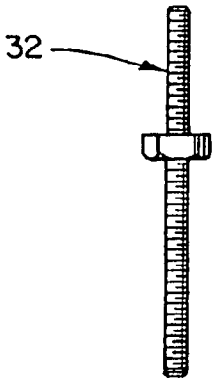
FIG. 7 is a side view of an incremental adjustable support mechanism of the columnar jack of FIG. 4.
Figure 8:
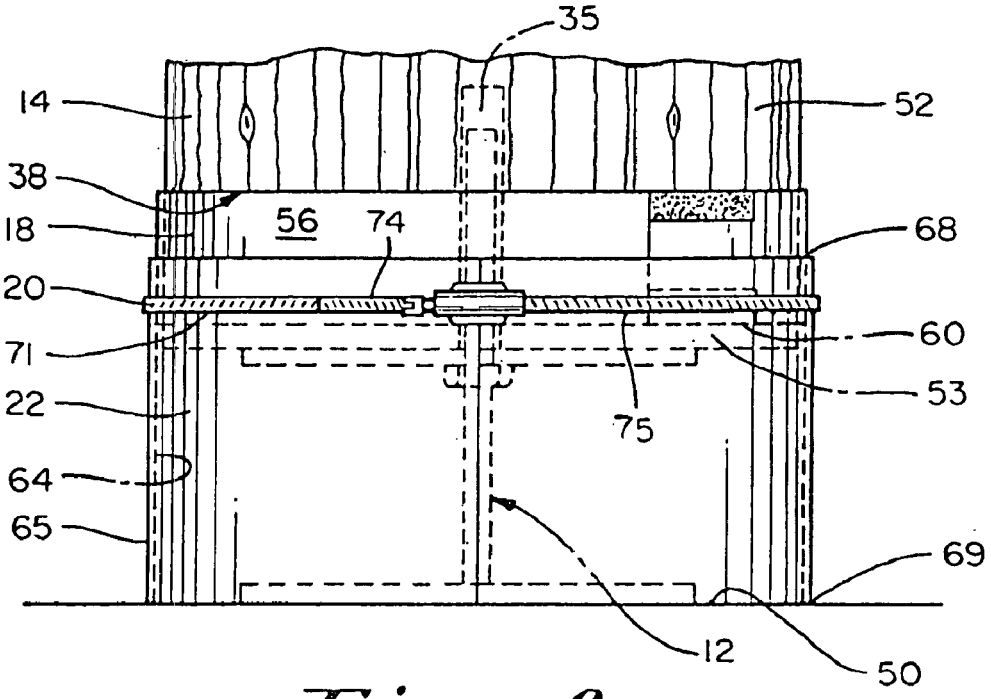
FIG. 8 is a cross-sectional view of an embodiment of the present invention showing installation and adjustment of the columnar jack and columnar covering device to the columnar member wherein the columnar jack is placed under the columnar covering at a bottom end of the columnar member.
Figure 9:
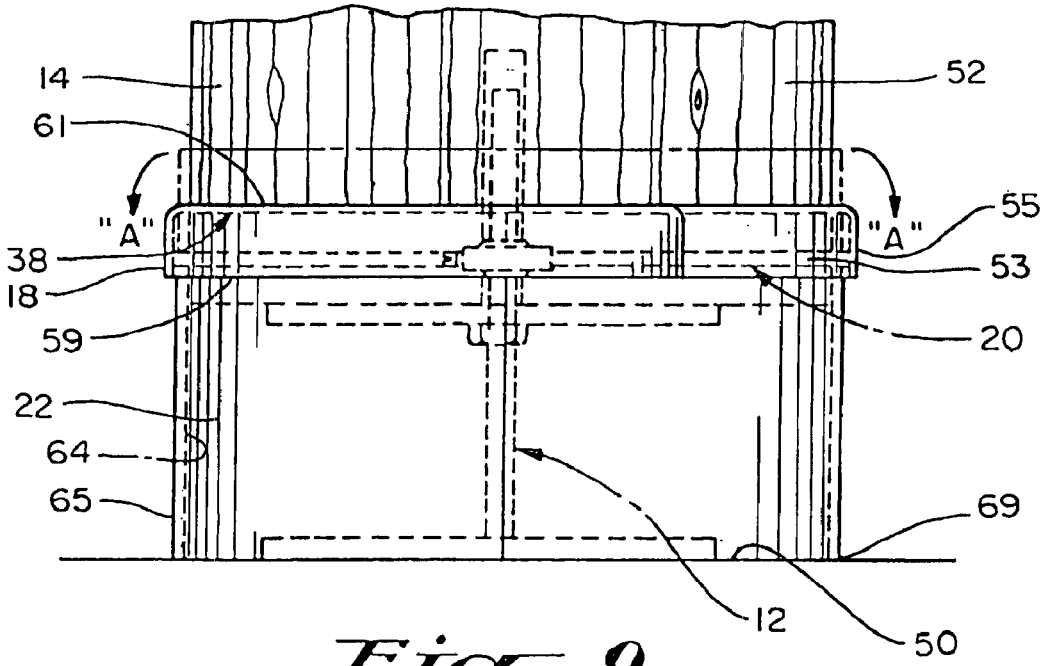
FIG. 9 is a cross-sectional view of the installation and adjustment of FIG. 8 showing a downward fold over a strap member and subsequent enclosure of a band member and a portion of a skirt member concealing the columnar jack therein.
Figure 10:
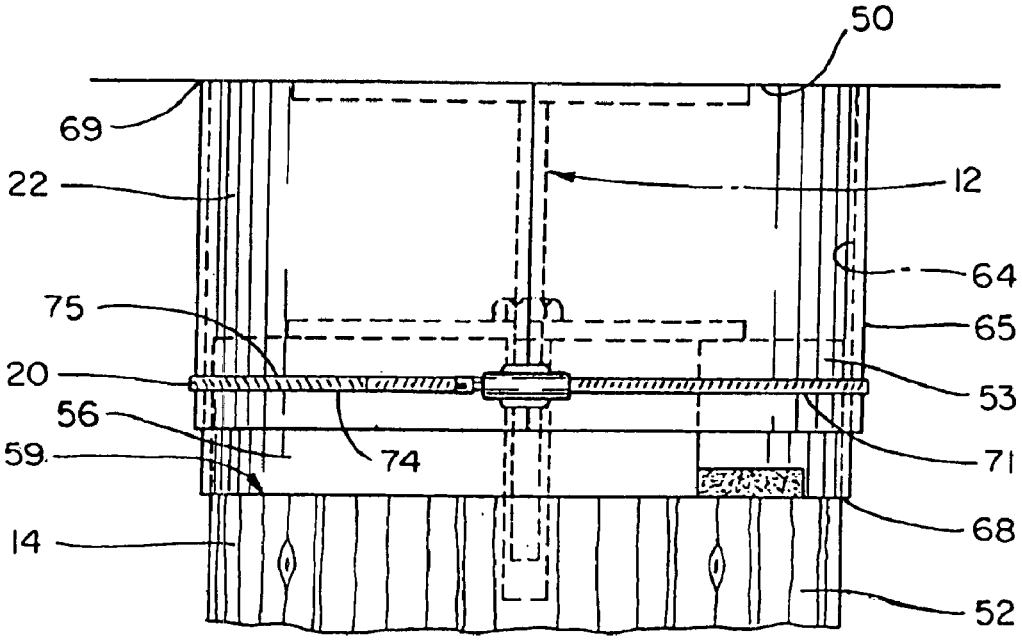
FIG. 10 is a cross-sectional view of an embodiment of the present invention showing installation and adjustment of the columnar jack and columnar covering device to the columnar member wherein the columnar jack is placed over the columnar covering at a top end of the columnar member.
Figure 11:
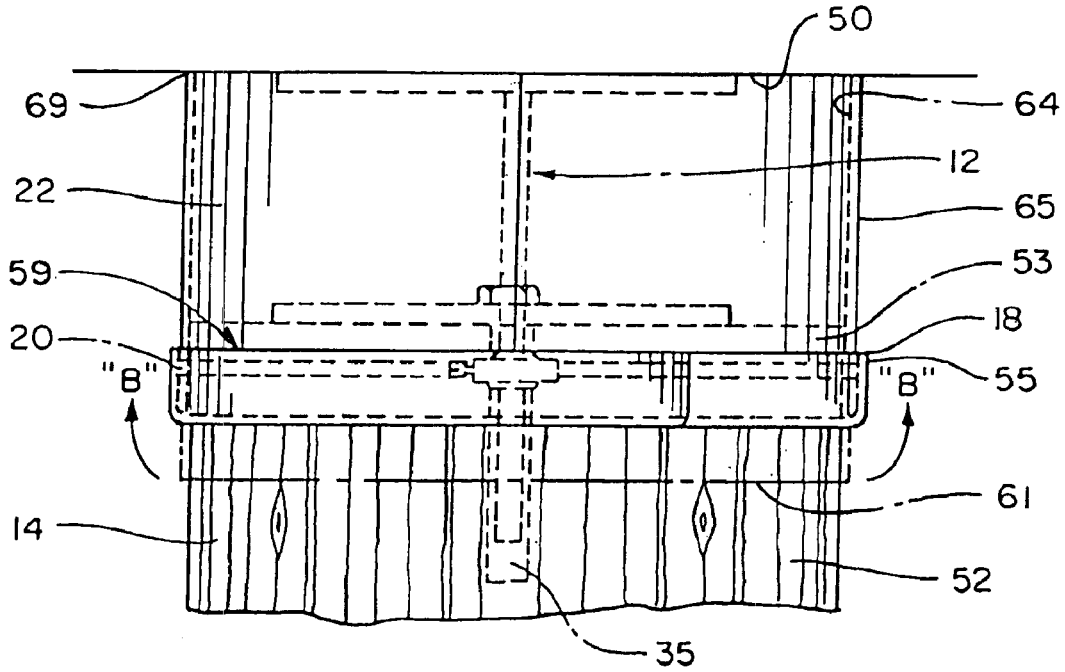
FIG. 11 is a cross-sectional view of the installation and adjustment of FIG. 8 showing an upward fold over a strap member and subsequent enclosure of a band member and a portion of a skirt member concealing the columnar jack therein.

The columnar structure supporting device 12, such as the columnar jack, can include adjustable columnar jacks, as illustrated in FIGS. 4–7. In a preferred embodiment, the columnar jack 12 is an adjustable columnar jack that comprises a base plate 30 (FIG. 6), an incremental adjustable support mechanism 32 (FIG. 7), such as a nut and bolt system, and a support plate 34 (FIG. 5). As shown in FIGS. 4 and 8–11, the columnar support 14 can have a hole 35 drilled into an end 36, be it a bottom end as referenced at 53 (FIGS. 8 and 9), a top end as referenced at 53 (FIGS. 10 and 11), a side, or at any angle or orientation that the columnar support may be angled at and to which is attached the columnar jack 12 or other columnar support device. The hole 35 is preferably sized to fit the particular incremental adjustable support mechanism 32 in such a way as to provide a secure fit. The support plate 34 should have a hole 42 drilled through it for passage and adjustment of the incremental adjustable support mechanism. The base plate 30 can also have a hole 44 at least partially drilled into it to secure the incremental adjustable support mechanism from slippage.

An important feature of the present invention is that it can be provided, manufactured, and sold as a kit, a columnar jack concealing kit for columnar supports and the like. The kit could include the columnar jack 12, the strap 18, the clamp 20, and the skirt 22 or any permutation of these items, including the columnar support 14. The kit could also be part of a larger package, such as a log cabin construction kit.

As mentioned above, the columnar covering device 10 is intended to be placed at any orientation required by the columnar support 14. In particular, the columnar covering device 10 can be positioned at both or either of the bottom end 38 (FIGS. 8 and 9) or the top end 40 (FIGS. 10 and 11) of the columnar support 14 as needed or by design. When positioned at the bottom end 38, the strap 18 can be folded downwards (Arrows A—A in FIG. 9) to cover itself, the clamp 20, the skirt 22, and at least a portion of the columnar support 14. When positioned at the top end 40, the strap 18 can be folded upwards (Arrows B—B in FIG. 11) to cover itself, the clamp 20, the skirt 22, and at least a portion of the columnar support 14. Therefore, the materials chosen for the strap and the skirt should be stiff enough to hold their form and to conceal the columnar jack 12 no matter what the directional orientation is.

The columnar covering device 10 can therefore provide an apparatus and means for concealing columnar supporting devices, such as-the columnar jack 12. The adjustability of the individual elements and parts discussed above allow the user to adjust, remove, replace, etc. each part to address each columnar support 14 and its movement, dimensions, shapes, and physical characteristics. These adjustments can be made quickly, efficiently, and cost-effectively and can be made during the life of the columnar support 14 as the material ages, shrinks, swells, and so forth or if replacement columnar supports have different length measurements. The simplicity of the device should also result in lower manufacture costs.

It is thus contemplated that the present invention discloses a structural column assembly or a structural column assembly kit for aesthetically and adjustably outfitting a columnar support of a building structure. In either case, it is a primary objective of the present invention to provide an aesthetically adjustable columnar support to a building structure, which building structure is generally referenced at 16 in FIG. No. 1. It will be seen from an inspection of FIG. No. 1 that building structure inherently comprises a structure-jack interface (as referenced at 50) and a structure-column interface (as referenced at 51). Structure-jack interface 50 is further referenced in FIG. Nos. 4, and 8–11.

It is thus contemplated that the structural column assembly preferably comprises columnar support 14, strap member 18, columnar jack 12, skirt member 22, and columnar clamp 20. It will be understood that columnar support 14 inherently comprises an outer columnar surface 52 as referenced in FIG. Nos. 1, 4, and 8–11: a column-jack end 53 as referenced in FIG. Nos. 4 and 8–11; a column-structure end 54 as referenced in FIG. No. 1; and a columnar length. It will be further understood from an inspection of FIG. No. 1 that the columnar length inherently extends intermediate column-jack end 53 and column-structure end 54. Notably, column-jack end 53 inherently has a column periphery magnitude or distance around the periphery thereof.

Strap member 18, as previously specified, is preferably constructed from a foldable material and inherently comprises an inner strap surface 55 as referenced in FIG. Nos. 1, 2, 9, and 11; an outer strap surface 56 as referenced in FIG. Nos. 2, 8, and 10; a first strap end 57 as referenced in FIG. No. 2; a second strap end 58 as referenced in FIG. No. 2; a strap length, a strap height, a fold edge 59 as referenced in FIG. Nos. 2, and 8–11; a stationary edge 60 as referenced in FIG. Nos. 2 and 8; a fold region as referenced at 61 in FIG. Nos. 9 and 11; and strap length adjustment means. It will be understood that the strap length inherently extends intermediate first strap end 57 and second strap end 58. Further, it will be readily understood that fold region 61 is essentially that region that is substantially equidistant from fold edge 59 and stationary edge 60. Further, the strap height inherently extends intermediate fold edge 59 and stationary edge 60.

Columnar jack 12 inherently comprises a structure-engaging portion 62 as referenced in FIG. No. 6; a column-engaging portion 63 as referenced in FIG. No. 5; and jack adjustment means (as defined, for example, by incremental adjustable support mechanism 32). Skirt member 22 is preferably constructed from a stiff material as earlier specified. Skirt member 22 inherently comprises an inner skirt surface 64 as referenced in FIG. No. 2, and 8–11; an outer skirt surface 65 as referenced in FIG. Nos. 1, 2, and 8–11; a first skirt end 66 as referenced in FIG. No. 2; a second skirt end 67 as referenced in FIG. No. 2; a skirt length; a skirt height; a strap-engaging edge 68 as referenced in FIG. Nos. 2, 8, and 10; a structure-engaging edge 69 as referenced in FIG. Nos. 2, and 8–11; and skirt length adjustment means. It will be understood that the skirt length inherently extends intermediate first skirt end 66 and second skirt end 67 and that the skirt height inherently extends intermediate strap-engaging edge 68 and structure-engaging edge 69.

Columnar clamp 20 inherently comprises an inner clamp surface 70 as referenced in FIG. Nos. 2 and 3; an outer clamp surface 71 as referenced in FIG. Nos. 2, 3, 8, and 10; a first clamp end 72 as referenced in FIG. No. 3; a second clamp end 73 as referenced in FIG. No. 3; a clamp length; a clamp height; a fold-side edge 74 as referenced in FIG. Nos. 2, 8, and 10; an open clamp edge 75 as referenced in FIG. Nos. 2, 8, and 10; and clamp length adjustment means 28 as earlier described. It will be readily understood that the clamp length inherently extends intermediate first clamp end 72 and second clamp end 73 and that the clamp height inherently extends intermediate fold-side edge 74 and open clamp edge 75.

It will be further understood from an inspection of the noted figures that structure-engaging portion 62 engages structure-jack interface 50 and that column-engaging portion 63 engages column-jack end 53. Further, column-structure end 54 engages structure-column interface 51. The jack adjustment means thus enables a user to vertically adjust columnar support 14. In this last regard, it will be understood that columnar jack 12 thus inherently has a vertically adjustable exposed jack height (as referenced at 76 in FIG. No. 4) intermediate column-jack end 53 and structure-jack interface 50. It will be further understood that the skirt height is preferably greater in magnitude than exposed jack height 76 as generally depicted in FIG. Nos.

8–11. Further, the strap height is preferably greater than twice the magnitude of the clamp height as generally depicted in FIG. No. 2.

It will be further understood from an inspection of the noted figures that inner strap surface 55 preferably engages outer columnar surface 52 adjacent column jack end 53 and thus strap member 18 conceals column-jack end 53. Strap-engaging edge 68 preferably engages outer strap surface 56 intermediate fold region 61 and stationary edge 60. Structure-engaging edge 69 preferably engages structure-jack interface 50 and thus skirt member 22 conceals columnar jack 12. Inner clamp surface 70 preferably engages outer skirt surface 65 adjacent strap-engaging edge 68 and thus columnar clamp 20 clamps skirt member 22 and strap member 18 to columnar support 14 adjacent column-jack end 53.

Strap member 18 is then preferably folded at fold region 61 and fold region 61 preferably engages strap-engaging edge 68. Outer strap surface 56 adjacent fold edge 59 Preferably engages outer clamp surface 71. Inner strap surface 55 adjacent fold edge 59 thus conceals clamp member 20. It will recalled that the material used in the construction of strap member 18, in order to more properly blend into the structure, preferably be in aesthetic agreement with the columnar support or structure. Thus, outer columnar surface 52 is preferably visually similar to inner strap surface 55 and outer skirt surface 65 so that the structural column assembly provides an aesthetically adjustable columnar support to the building structure.

From a general inspection of FIG. No. 2 as well as consideration of FIG. Nos. 8–11, it will be understood that the strap length adjustment means, the skirt length adjustment means, and the clamp length adjustment means are operable to adjust the strap length, the skirt length, and the clamp length (respectively) according to the column periphery magnitude. Further, it will be understood that the structure-jack interface may preferably be defined by the superior surface of a column support structure of the building structure (the floor surface of building structure 16 as depicted in FIG. No. 1) and the structure-column interface may preferably be defined by the inferior surface of a ceiling support structure of building structure 16 (the underside of the log supporting the overhand as generally depicted in FIG. No. 1).

Finally, in usage the present invention provides a method of installing a columnar jack concealing kit 10 for a columnar support 14, as shown in FIGS. 8–11. The method comprises the acts of first, providing a columnar jack 12 and then attaching the columnar jack 12 to the columnar support 14 and adjusting the columnar jack 12 for securing the columnar support 14. The next act is wrapping an adjustable, flexible strap 18 about the secured columnar support 14 and adjusting the adjustable, flexible strap 18 upon itself for securing the adjustable, flexible strap 18 to the secured columnar support 14. What can follow is wrapping an adjustable, stiff skirt 22 about the secured adjustable, flexible strap 18 and the secured columnar support 14 and adjusting and securing the adjustable, stiff skirt 22 to the secured adjustable, flexible strap and the secured columnar support.

The next act is covering the attached columnar jack 12 with the secured adjustable, stiff skirt 22 and concealing the attached columnar jack 12 from view followed by mounting, adjusting, and securing a mechanically adjustable clamp 20 around and over the secured adjustable, flexible strap 18, the secured adjustable, stiff skirt 22, and the secured columnar support 14 for maintaining concealment of the attached columnar jack 12. Finally, the installation is completed by folding the secured adjustable, flexible strap 18 over the secured adjustable, stiff skirt 22, or at least a part of it, and over the secured mechanically adjustable clamp 20 for concealing the secured adjustable, stiff skirt 22 and the secured mechanically adjustable clamp 20. In this way the present invention can protect the clamp 20 and the columnar support 14 from moisture and users or other people, such as kids, from sharp edges on the clamp 20. Moreover, the strap 18 can conform to a variety of columnar support surfaces, be they circular, square, irregular, etc. so that the device 10 can be universally used.

As discussed above, this installation can be performed right-side up (FIGS. 8 and 9), upside-down (FIGS. 10 and 11) or at any orientation. The installation is quick and easy and if adjustments or removal are needed to the columnar jack 12 or columnar support 14, then the columnar jack concealing kit 10 can be uninstalled quickly and easily and can be reused later on the same or any other columnar support 14. To uninstall the kit 10, the procedure can include the following acts: unfolding the secured adjustable, flexible strap 18, loosening and removing the mechanically adjustable clamp 20, uncovering the attached columnar jack 12, unwrapping and removing the adjustable, stiff skirt 22, unwrapping and removing the adjustable, flexible strap 18, and loosening and detaching the columnar jack 12 from the columnar support 14.

Moreover, the acts discussed above are preferably performed sequentially as disclosed, although the acts can be performed in any order that satisfies the scope and intent of the invention. For example, the skirt 22 could be placed on the columnar support 14 before the strap 18 and then both could be bound by the clamp 20 before the strap is folded over itself and the other parts.

In construction and in use the present invention therefore provides a columnar covering device for a columnar jack that has universal application with varying columnar construction sizes, shapes, and lengths, requires few working parts, reduces the likelihood of material waste, accommodates immediate access for jack and material adjustments, due to such causes as shrinkage and swelling, and is easy to use and manufacture.

Thus, while the above description contains much specificity, this specificity should not be construed as limitations on the scope of the invention, but rather as an exemplification of the invention. For example, it is believed that the spirit of the present invention discloses a structural column assembly and kit wherein strap-engaging edge 68 alternatively engages columnar support 14 (instead of inner strap surface 55 adjacent stationary edge 60) adjacent column-jack end 53 and that structure-engaging edge 69, as before, preferably engages structure-jack interface 50. Skirt member 22 thus may alternatively conceal columnar jack 12 and column-jack end 53 from view. Inner strap surface 55 may alternatively engage outer skirt surface 65 adjacent strap-engaging end 68 and inner clamp surface 70 may then alternatively engage outer strap surface 56 adjacent stationary edge 60. Thus, columnar clamp 20 preferably attaches strap member 18 and skirt member 22 to columnar support 14 adjacent column-jack end 53. Strap member 18 may then be alternatively folded at fold region 61. Outer strap surface 56 adjacent fold edge 59 thus may alternatively engage outer clamp surface 71 and fold region 61 may alternatively engage fold-side edge 74. Inner strap surface 55 adjacent fold edge 59 thus conceals clamp member 20. Notably, in either the preferred or alternative scenario, outer columnar surface 52 is preferably visually similar to inner strap surface 55 as well as outer skirt surface 65 and thus, the structural column assembly provides an aesthetically adjustable columnar support to building structure 16.

As various possible embodiments may be made in the above invention for use for different purposes and as various changes might be made in the embodiments and methods above set forth, it is understood that all of the above matters here set forth or shown in the accompanying drawings are to be interpreted as illustrative and not in a limiting sense.

What is claimed is:

1. In combination, a columnar jack concealing structure, the columnar jack concealing structure comprising:

an adjustable, foldable strap;

an adjustable columnar jack;

a stiff skirt circumferentially adjustable relative to the columnar support, the stiff skirt aesthetically concealing the adjustable columnar jack;

a mechanically adjustable clamp, the clamp having an inner and outer surface;

a columnar support, the adjustable columnar jack supporting and securing the columnar support, the adjustable, foldable strap surrounding and engaging a strap portion of the columnar support, the strap portion being adjacent the adjustable columnar jack, the stiff skirt engaging a skirt portion of an outer surface of the adjustable, foldable strap, the mechanically adjustable clamp engaging a clamp portion of the an outer surface of the stiff skirt, the skirt portion and the clamp portion being sandwiched intermediate the strap portion and the mechanically adjustable clamp, the mechanically adjustable clamp clamping the adjustable stiff skirt to the adjustable, foldable strap and the adjustable, foldable strap to the columnar support, the outer surface of the foldable strap having a fold portion, the fold portion of the adjustable, foldable strap being folded over the outer surface of the mechanically adjustable clamp and the clamp portion thereby aesthetically and protectively concealing the mechanically adjustable clamp, the clamp portion, and the strap portion.

2. The combination of claim 1, wherein the columnar support has a top end and a bottom end opposite the top end, the adjustable columnar jack being positioned at either the top end or the bottom end and concealed thereat by the adjustable, stiff skirt.

3. The combination of claim 1, wherein the adjustable, foldable strap is an annular band member having ends, the ends being disposed in lapped relation, the adjustable, foldable strap being adjustable to cooperatively engage varying sizes, dimensions, and shapes of columnar supports, the columnar supports having a cross-section selected from the group consisting of circular, square, and irregular cross-sections, the adjustable, foldable strap providing moisture protection to the columnar support.

4. The combination of claim 3, wherein the adjustable, foldable strap is constructed of a moisture adsorbing material.

5. The combination of claim 1 wherein the combination further comprises, a building structure, the building structure being a log cabin, and the columnar support is a wood column, the wood column being attached to and supporting a portion of the log cabin.

6. A columnar structural support assembly, the columnar structural support assembly comprising, in combination:

a columnar support having a strap engaging portion;

an adjustable strap member having an inner and outer surface;

an adjustable clamp having an inner and outer surface;

an adjustable columnar jack; and an adjustable sleeve having an inner and outer surface, the adjustable strap member being constructed of a foldable material the adjustable strap member comprising a skirt portion and a fold portion, the skirt portion engaging a strap portion of the columnar support, the adjustable sleeve engaging the skirt portion on the outer surface of the strap member, the adjustable clamp engaging a clamp portion on the outer surface of the adjustable sleeve, the skirt portion and the clamp portion being sandwiched intermediate the strap engaging portion and the adjustable clamp, the fold portion over upon and concealing the outer surface of the adjustable clamp and the clamp portion thus providing a visually aesthetic cover for the adjustable clamp the clamp portion and the strap portion, the adjustable clamp clamping the adjustable sleeve to the adjustable strap member and the adjustable strap member to the columnar support, the adjustable sleeve being constructed of a stiff material, the adjustable sleeve thus providing a visually aesthetic cover for the adjustable columnar jack.

7. The columnar structural support assembly of claim 6, wherein the foldable material of the adjustable strap member and the stiff material of the adjustable sleeve coact with the adjustable clamp to extend upwards or downwards, over the adjustable columnar jack.

8. A structural support assembly, the structural support assembly comprising, in combination:

an adjustable strap member having an inner and outer surface;

an adjustable clamp having an inner and outer surface;

an adjustable columnar jack;

an adjustable sleeve having an inner and outer surface; and a select structural support, the select structural support comprising a select support end having a strap engaging portion, the adjustable columnar jack being positioned adjacent the select support end, the adjustable strap member being constructed of a foldable material, the adjustable strap member comprising a skirt portion and a fold portion, the skirt portion engaging the select support end at the strap engaging portion, the adjustable sleeve engaging the skirt portion on the outer surface of the adjustable strap, the adjustable clamp engaging a clamp portion on the outer surface of the adjustable sleeve, the skirt portion and the clamp portion being sandwiched intermediate the strap engaging portion and the adjustable clamp, the fold portion being folded over upon and concealing the outer surface of the adjustable clamp and the clamp portion, the adjustable strap member thus providing a visually aesthetic cover for the adjustable clamp, the clamp portion and the strap portion, the adjustable clamp clamping the adjustable sleeve to the adjustable strap member and the adjustable strap member to the columnar support, the adjustable sleeve being constructed of a stiff material, the adjustable sleeve providing a visually aesthetic cover for the adjustable columnar jack.

9. The structural support assembly of claim 8, wherein the foldable material of the adjustable strap member and the stiff material of the adjustable sleeve coact with the adjustable clamp to extend upwards, or downwards over the adjustable columnar jack, the adjustable strap member being an annular strap member, the annular strap member comprising a soft cloth material, the annular strap member being in lapped engagement about the select structural support and itself.

10. The structural support assembly of claim 9 wherein the foldable material and the stiff material present a uniform, visually aesthetic appearance, the uniform, visually aesthetic appearance blending with the select structural support.

11. The structural support assembly of claim 8 wherein the select structural support is selected from the group consisting of a column, a post, a beam, and a joist.

12. The structural support assembly of claim 8 wherein the select support end is selected from the group consisting of a top end and a bottom end.

13. A structural column assembly, the structural column assembly providing aesthetically adjustable columnar support to a building structure, the building structure comprising a structure-jack interface and a structure-column interface, the structural column assembly comprising, in combination:

a columnar support, a strap member, a columnar jack, a skirt member, and a columnar clamp, the columnar support comprising an outer columnar surface, a column-jack end, a column-structure end, the column-jack end having a column periphery magnitude, the strap member being constructed from a foldable material, the strap member comprising an inner strap surface, an outer strap surface, a first strap end, a second strap end, a strap length, a strap height, a fold edge, a stationary edge, a fold region, and strap length adjustment means, the strap length extending intermediate the first and second strap ends, the fold region being substantially equidistant from the fold edge and the stationary edge, the strap height extending intermediate the fold edge and the stationary edge, the columnar jack comprising a structure-engaging portion, a column-engaging portion, and jack adjustment means, the skirt member being constructed from a stiff material, the skirt member comprising an inner skirt surface, an outer skirt surface, a first skirt end, a second skirt end, a skirt length, a skirt height, a strap-engaging edge, a structure-engaging edge, and skirt length adjustment means, the skirt length extending intermediate the first and second skirt ends, the skirt height extending intermediate the strap-engaging edge and the structure-engaging edge, the columnar clamp comprising an inner clamp surface, an outer clamp surface, a first clamp end, a second clamp end, a clamp length, a clamp height, a fold-side edge, an open clamp edge, and clamp length adjustment means, the clamp length extending intermediate the first and second clamp ends, the clamp height extending intermediate the fold-side edge and the open clamp edge, the structure-engaging portion engaging the structure-jack interface, the column-engaging portion engaging the column-jack end, the column-structure end engaging the structure-column interface, the jack adjustment means enabling a user to vertically adjust the columnar support, the columnar jack thus having a vertically adjustable exposed jack height intermediate the column-jack end and the structure-jack interface, the skirt height being greater in magnitude than the exposed jack height, the strap height being greater than twice the magnitude of the clamp height, the inner strap surface engaging the outer columnar surface adjacent column jack end, the strap member thus concealing the column-jack end, the strap-engaging edge engaging the outer strap surface intermediate the fold region and the stationary edge, the structure-engaging edge engaging the structure-jack interface, the skirt member thus concealing the columnar jack, the inner clamp surface engaging the outer skirt surface adjacent the strap-engaging edge, the columnar clamp clamping the skirt member and the strap member to the columnar support adjacent the column-jack end, the strap member being folded at the fold region, the fold region engaging the strap-engaging edge, the outer strap surface of the strap member engaging the outer clamp surface when folded, the inner strap surface adjacent the fold edge thus concealing the clamp member, the outer columnar surface being visually similar to the inner strap surface and the outer skirt surface, the structural column assembly thus providing aesthetically adjustable columnar support to the building structure.

14. The structural column assembly of claim 13 wherein the strap length adjustment means, the skirt length adjustment means, and the clamp length adjustment means are operable to adjust the strap length, the skirt length, and the clamp length according to the column periphery magnitude.

15. The structural column assembly of claim 13 wherein the structure-jack interface is a superior surface of a column support structure of the building structure and the structure-column interface is an inferior surface of a ceiling support structure of the building structure.

16. The structural column assembly of claim 13 wherein the strap is constructed from a moisture-adsorbing material.

* * * * *